US006526733B1

(12) United States Patent
Schellenberg et al.

(10) Patent No.: US 6,526,733 B1
(45) Date of Patent: Mar. 4, 2003

(54) DEVICE FOR ALIGNING A PACKING MATERIAL TUBE WITH A POSITION MARK

(75) Inventors: Frank Mario Schellenberg, Hochheim (DE); Steffen Polster, Hochheim (DE); Mauro Cavazzuti, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/857,358

(22) PCT Filed: Jan. 14, 1999

(86) PCT No.: PCT/EP99/00177

§ 371 (c)(1),
(2), (4) Date: Jun. 4, 2001

(87) PCT Pub. No.: WO00/41932

PCT Pub. Date: Jul. 20, 2000

(51) Int. Cl.[7] ..... B65B 9/06

(52) U.S. Cl. ..... 53/551; 53/64; 53/370.6; 53/372.5; 493/8; 493/9; 493/11; 493/231; 493/243; 493/429

(58) Field of Search ..... 53/551, 51, 64, 53/552, 370.6, 372.5, 389.2; 493/58, 8, 9, 10, 11, 24, 187, 188, 243, 231, 429

(56) References Cited

U.S. PATENT DOCUMENTS 4,079,662 A * 3/1978 Puccetti et al. ..... 493/203
4,924,656 A * 5/1990 Kovacs et al. ..... 53/170
5,832,701 A * 11/1998 Hauers et al. ..... 53/289
6,029,428 A * 2/2000 Terminella et al. ..... 53/133.4
6,408,599 B1 * 6/2002 Nakagawa et al. ..... 53/451

* cited by examiner

*Primary Examiner*—Rinaldi I. Rada
*Assistant Examiner*—Gloria R Weeks
(74) *Attorney, Agent, or Firm*—Michael L. Dunn

(57) ABSTRACT

The invention relates to a device for aligning a packing material tube (1) with a treatment station in a packaging machine in which a tube (1) with a circular cross-section is produced from a strip of printed packaging material having embossed lines. Said tube is closed by longitudinally sealing it, filled and shaped in a cross-sealing unit (12) and divided into cuboid packages. The unit (12) is provided with an adjustable lift of stroke so that it intermittently convey the tube (1). It is also provided on diametrical sides with a folding flap (16) that can be pivoted about an axis (15). For feeling the position mark, a sensor is arranged. The aim of the invention is to facilitate a faster termination of the initial phase when the packaging machine is put into operation while at the same time producing less cuttings and to prevent the paper tube from being damaged. To this end, a folding finger (19) is arranged upstream of every folding flap (16). Said folding finger folds the tube (1) to a width that is approximately equal to the finished package in such a manner that the tube (1) is located outside the folding flaps (16).

20 Claims, 9 Drawing Sheets

DEVICE FOR ALIGNING A PACKING MATERIAL TUBE WITH A POSITION MARK

Figure 1:
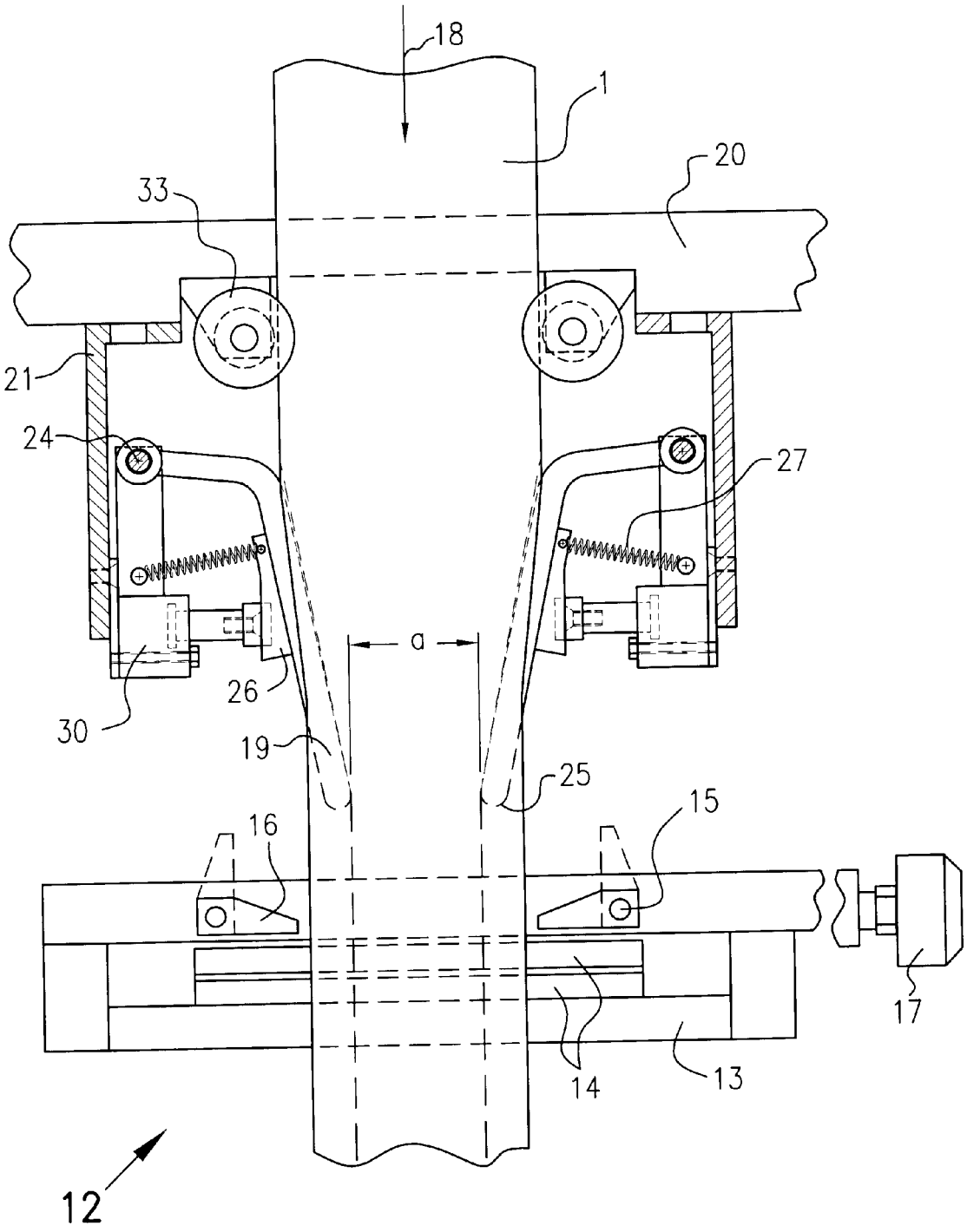

The invention concerns an apparatus for setting a tube of packaging material in relation to a processing station in a packaging machine in which a tube of round cross-section is formed from a printed web of packaging material provided with embossing lines, closed by longitudinal sealing, filled and shaped in a transverse sealing unit and divided into parallelepipedic packs, wherein the transverse sealing unit is designed for intermittently conveying the tube with an adjustable stroke movement and is provided in relation to the tube on diametrally opposite sides with a respective folding flap pivotable about a pivot axis, and a sensor is arranged to sense a printing mark.

DE 29 46 059 discloses an apparatus which forms a tube of packaging material, in particular paper coated with plastic material, by longitudinal sealing, fills it, shapes it at least in the lower region by means of a transverse sealing unit intermittently conveying the tube, and divides the tube into individual packs, wherein the filled closed parallelepipedic packs, after reaching the end of a first vertical processing path, are subjected to final shaping on a second horizontal processing path and are conveyed away.

It is known that liquid products are packed in such parallelepipedic packs, for example long-life milk, and that a decoration which assists with the advertising is printed on the outside surface of the pack. Besides the decoration, printed on the pack in a fixed position in relation to the decoration there is also a printing mark while approximately at spacings of a good pack height there are also embossing lines in the tube, which facilitate the shaping operation. The transverse sealing unit conveys the tube intermittently by a given stroke movement which, in the case of an in-house state of the art, is equal to the height of the parallelepipedic pack to be produced plus double the sum of half the depth of the parallelepipedic pack and the height of the transverse sealing seam of the pack material, which connects the tube body portion of the parallelepipedic pack to the transverse sealing seam.

It will be appreciated that the transverse sealing unit with its transverse sealing jaws and the separating blade must be in the correct position relative to the embossing lines on the one hand and the decoration and the printing mark on the other hand, if satisfactory operation is to be guaranteed. In a further in-house state of the art, for that purpose there is provided a correction device which increases or reduces the length of the movement of the folding flaps in such a way that, in operation of the transverse sealing unit with which the folding flaps co-operate, the folding flaps convey either more or less packaging material, that is to say tube length, in the respective conveyor stroke movement. Such a correction device operates satisfactorily for the correction of relatively small displacements and in particular in the continuous procedure of filling, closing and separating the tube into packs.

Problems however have frequently arisen in the initial phase when the filling material, that is to say the product to be packed, for example milk, has not yet been supplied and the tube of the web of packaging material is just being formed for the first time and is being conveyed by the transverse sealing unit in the initial phase of the procedure. More specifically, the printing mark is then not at the correct location, for example it is not in front of the sensor, so that the operator knows that the decoration and the embossing lines are not at the correct, intermittently recurring distance from the transverse sealing unit. The tube of the packaging material therefore has to be adjusted or set or oriented, and that was managed by controlling the correction device and therewith the position of the folding flaps to move to a predetermined position in order thereby to move the printing mark to the correct position, for example in front of the sensor, during the intermittent movement.

As in the above-mentioned position of the folding flaps the paper tube is also disposed in the region of engagement of the folding flaps, the folding flaps, by virtue of the undefined shape of the tube of packaging material, implement a proportion, which is not to be estimated, of the length of conveying movement of the tube of paper. That means that the commencement of production of filled, properly decorated packs is linked to the preceding production of an indefinite number of filled waste packs which are not properly decorated. The number of waste packs produced is dependent on the one hand on the time at which a stable product filling height in the paper tube is reached and on the other hand on the above-mentioned factors and circumstances. That procedure involves the disadvantage that a relatively large number of packs had to be conveyed without producing a satisfactorily filled, sealed pack provided with the correct decoration. The amount of waste which is involved in that respect is disproportionately high. Up to the moment at which correct positioning of the printing mark was reached, between 30 and 60 packs were lost as wastage, in which case up to 20 packs were partially filled with liquid product. That therefore also involved the disadvantage that an intolerably long period of time elapsed before the cut in the transverse sealing unit was positioned at the correct location relative to the tube.

In terms of practical use of present machines, in the initial phase thereof, when setting the tube in relation to the transverse sealing unit as the processing station, the further disadvantage was incurred, if the tube of packaging material is of a round cross-section, that the folding flaps contact the tube from the outside and urge it inwardly in an undefined manner, in which case the tube is creased and in part even damaged. The undefined bend lines in the plastic-coated surfaces on the inside and/or outside of the tube give rise to damage and cracks which result in a loss of sealing integrity for liquids or lack of sterility in the case of sterile packs. On the other hand however the movement of the folding flaps is indispensable in order to provide the desired folded configuration at the respective lower end of the tube body portion of the pack. The folding flap control, the movement of the flaps and the technical components for implementing that flap movement are complicated and take up a great deal of space so that it is not possible to switch off the flap movement at just any times when the tube is in the initial phase of being set.

Therefore, the object of the present invention is to provide an apparatus of the kind set forth in the opening part of this specification, which permits faster termination of the initial phase when setting the packaging machine in operation, with a smaller amount of waste material, in order to prevent damage to the paper tube and to considerably reduce the loss of product during the start-up phase.

In accordance with the invention that object is attained in that arranged on the upstream side of each folding flap is a folding element which is driven controlledly by the sensor and by means of which the tube can be folded in to a width approximately equal to the width of the finished pack in such a way that the tube is out of engagement from the folding flaps.

The folding element which is of a very simple design configuration and which can be easily driven and which is arranged upstream of the respective folding flap in the direction of movement of the tube can provide that the tube can be brought out of engagement from the folding flaps in its region downstream of the operative location of the folding elements and in particular through the transverse sealing unit. That mode of folding applies only for the initial phase of operation of the packaging machine, during which the tube of packaging material is being adjusted or suitably oriented. During that initial phase, the result obtained is a pack portion which is folded differently or, to put it better, a tube portion which does not lead to the parallelepipedic pack which is ultimately wanted, because for example the folding flaps cannot implement their function which is necessary for expanding the parallelepipedic pack into the proper shape. The initial phase however can be kept short by means of the folding elements according to the invention so that the initial phase when setting the machine in operation can be concluded very quickly, with the consequence that considerably less waste material is also incurred. While in the previously known initial phase packaging material for between about 30 and 60 packs was lost as wastage, in accordance with the invention the level of wastage is two thirds or half. When dealing for example with an aseptic pack whose production tube is sterilised, then in the known tube-setting procedure in the initial phase of the machine between about 12 and 16 packs filled with product occurred as wastage. In accordance with the invention, the tube-setting procedure for a sterile tube of packaging material is implemented in the described manner so rapidly that only material and product corresponding to two packs at the downstream leading end of the processed tube is lost as wastage.

If another section of the packaging machine is considered, more specifically the procedure for forming the finished tube body portion of the pack, when the sterilisation procedure begins, then hitherto there was a fear in that region that the paper tube was damaged due to the preceding movements of the folding flaps, without such damage having been noticed, so that the success of the sterilisation step is in question.

The operation of folding in the tube by means of the folding elements is particularly expediently successful if in accordance with the invention the folding elements fold the tube symmetrically inwardly to such an extent that in cross-section between the side wall which is folded in at an angle and the adjacent flat side wall, there is an angle of between about 5° and 85°, preferably between about 15° and 17° and quite particularly preferably between about 30° and 60°. If that angle is referred to for example as $\alpha$, then it is considered and measured when considering the tube cross-section in the folded-in condition. In that folded-in condition, there is formed between a pair of longitudinal fold lines at one side a side wall which is by and large flat and opposite which, by virtue of suitable relationships, there is on the other side a flat side wall. In the case of the usual 1 litre parallelepipedic milk pack, this involves for example the two large, wide, flat side walls which are joined by narrow side walls. In the view in cross-section, the one limb of the angle $\alpha$ is therefore afforded by the straight line which extends in the by and large flat side wall, and an adjacent straight line which is disposed inclinedly with respect thereto and which extends in the narrow side wall, more specifically beginning at the end folding line from which the folding element folds in that narrow side wall. Without a folding element and without a folding-in configuration in the finished parallelepipedic pack, that angle $\alpha$ is about 90°. It will be appreciated that this angle is reduced by the folding-in procedure, that is to say due to the action of the folding elements. It will be appreciated that in that way also the two mutually oppositely disposed flat side walls are moved closer towards each other. That folding-in effect in such a way that the folding elements move from the outside inwardly provides that the later narrow side walls move angularly inwardly of the parallelepipedic contour, and not for example outwardly, as could also be folded. That inward folding first provides that the material of the tube can be brought entirely out of engagement from the folding flaps. Damage or creasing is then no longer possible in this initial phase.

It will be appreciated that the action of the folding elements is deployed during the intermittent transportation of the tube of packaging material. It is to be noted in this respect that the folding elements are in a fixed position relative to the packaging machine. The tube moves relative to them.

It is also advantageous in accordance with the invention if the folding element is an elongate folding finger which is pivotable about a pivot axis and which is secured to the machine and which is arranged parallel to the pivot axis of the folding flap, and if the folding finger extends from its pivot axis along the tube to a position in front of the transverse sealing unit. Such a folding finger is simple to produce and affords a robust function. If the path of conveying movement of the tube is assumed to be substantially vertical in the sense that the tube moves intermittently downwardly, then the pivot axis of the folding finger is disposed above and upstream of the folding flap in question; also on the same side of the tube as the folding flap. The other is arranged in diametrally opposite relationship. The pivot axis essentially forms the one, upstream, upper end of the folding finger in question, and the operative end is disposed in opposite relationship, downstream, at the lower end.

As in the known situation the sensor, for example a photoelectric cell, senses the printing mark and outputs a signal corresponding to the spacing, as measured in the direction of transportation movement, of the printing mark from the sensor. That spacing is a measurement in respect of the correct position of the printing mark. In this case, the printing mark can be a black or coloured line or point on a white background. The printing mark however may also be of a more complicated configuration. To simplify the illustration, it is assumed that the printing mark is a simple line. It is also assumed that the decoration is disposed at the correct location with respect to the embossing lines when it comes to a stop at the end of the intermittent movement in front of the sensor. It is assumed that at that moment the blade in the transverse sealing unit is at the correct position between two blanks. Each blank in fact is of a length L which is composed of the height H of the subsequent finished parallelepipedic pack plus the two folding panels with the embossing lines plus the width of the transverse sealing seam. The stroke movement with which the transverse sealing unit intermittently advances the tube both in the start-up phase of operation of the packaging machine and also in the on-going operation thereof is less than that total length L.

If in the start-up phase the folding finger is caused to fold the tube in to the width B of the finished pack in the described manner, then that modified folding effect gives a shorter tube length by which the tube of packaging material is intermittently conveyed in front of the transverse sealing unit in the start-up phase. In that way, without displacement of the correction unit (the folding flaps are not operative in the initial phase), the printing mark can be caused to move considerably more quickly relative to the sensor, with the result that, after only a few initial portions of the tube which look like packs folded in a cushion shape have passed through, the printing mark is at the correct location and the full mode of operation can be initiated.

If, in a further configuration of the invention, a shaping roller is free-runningly rotatably arranged upstream of the pivot axis of each folding element, then the tube can be precisely supported, shaped and held in that configuration which in cross-section is for example round (circular or oval), while the folding elements begin the folding-in procedure thereof at a short distance downstream or beneath same. The folding conditions become stable as a result.

It is advantageous in that respect if, in accordance with the invention, the folding finger is also rounded off at its operative end arranged downstream of the pivot axis, at least on the side towards the tube, or carries a freely rotatable folding roller. That additionally provides that the tube of packaging material is not damaged even upon engagement of the folding finger therewith. The folding finger can be straight or curved and can extend in the transportation direction of the intermittently moved tube or at an angle relative to the tube. At any event the operative ends of the two oppositely disposed folding fingers or the folding rollers must reduce the spacing between them, at the moment of the initial phase and their action, so that on the outside the tube attains approximately the above-mentioned width of the later finished pack.

It is also advantageous in accordance with the invention if each folding element has its own drive which is separately actuable in itself, preferably a compressed air cylinder co-operating with a tension spring. The respective folding element can then act without any dead times or direction-changing levers, directly, and over short distances. It can be rapidly brought into and taken out of operation, more specifically at the beginning of the setting phase which produces the waste material, up to the end thereof. That period of time should be as short as possible. Due to the action of the folding elements, the differently shaped packaging material tube is produced, with the advantageous property that, even if the printing mark is initially incorrectly positioned, it very quickly moves into the correct position. After the correct position of the printing mark is reached the folding elements are shifted out, the product feed is switched on and the folding flaps begin immediately, more specifically automatically, with their action on the tube. At the moment at which the folding elements are pivoted out of their operative position into their condition of being moved away from each other, the procedure switches over from the one fold state of the tube into the other, although the folding flaps do not require a special control device. Rather, they operate entirely throughout in the same manner during the whole operating procedure. They only have no action in the initial phase because the tube is folded away from them.

A preferred embodiment of the invention is characterised in that the folding element is a folding roller which is mounted rotatably on a guide and whose axis of rotation extends parallel to the pivot axis of the folding flap, and that the guide is driven movably forwards and backwards transversely with respect to the tube. Instead of a folding finger which is rounded at the front or which at the front carries a folding roller representing the operative end of the folding finger, it can also be provided that secured to the machine is a pneumatic or hydraulic cylinder whose piston is movable towards the processing station and retractable therefrom. If then the above-mentioned guide is disposed at the front free end of the piston, the folding roller can be moved towards and retracted from the processing station. The same is also to be provided on the side in opposite relationship with respect to the tube, so that the two folding rollers are moved closer together for the operative condition and are moved further away from each other for the rest condition. The respective folding roller can again act without dead times in a particularly direct manner and over short distances. The same advantages are enjoyed, as are achieved as mentioned above with the folding elements. The folding elements which are in the form of folding fingers can be pivoted outwardly and the folding elements with the rotatably mounted folding roller at the front operative end can be advanced directly into engagement with the tube and retracted therefrom again transversely with respect to the direction of movement of the tube and transversely with respect to the tube.

It is advantageous in that respect if, in accordance with the invention, the spacing of the operative ends of the folding elements from each other a) is greater in the condition of being moved away from each other than the diameter D of the tube and b) is smaller in the condition of being moved towards each other than the width B of the substantially flat side wall of the inwardly folded tube, which side wall is adjacent to the side wall which is folded in at an angle in cross-section. That adjacent side wall was referred to hereinbefore in connection with a specific embodiment of a parallelepipedic pack as the narrow side wall while the substantially flat other side wall was the large, wide side wall. The width B is measured at the substantially flat side wall so that this predetermines the so-called width of the subsequent pack.

In a further advantageous configuration of the invention the folding elements centrally engage the side walls on sides which are in diametrally opposite relationship in terms of the cross-section of the tube. In the case of the parallelepipedic 1 litre milk pack of the above-discussed embodiment, this involves the narrow side walls. The folding elements do not contact the other wide side walls of the pack. By virtue of central engagement at the oppositely disposed narrow side walls, the movement of the folding elements extends in substantially one plane which is approximately parallel to the plane of the two substantially flat wide side walls.

In operation, firstly the empty tube is formed by longitudinal sealing and a substantially round cross-section is imparted thereto, with an overlapping longitudinal sealing seam. As viewed in the direction of transportation movement, filling pipe devices project into the tube upstream of the device for producing the longitudinal sealing seam. The filling pipe devices project to a position just in front of the shaping rollers or even between them. The shaping rollers and also the rotational or pivot axes of the folding elements are disposed upstream and, in the simplified embodiment being considered here, vertically above the transverse sealing unit which implements intermittent transportation of the tube of packaging material.

In the start-up phase the tube which is inserted at any height with the printing mark in the wrong position must firstly receive at the bottom a transverse sealing seam so that it becomes liquid-tight and can be sterilised. Straightaway the folding elements are brought into operation and the movement of the transverse sealing unit provides that one transverse sealing seam after the other is produced through a narrowly folded, cushion-shaped or also shingle-shaped pack, which have not come into contact with the folding flaps. After a few stroke movements, for which purpose two stroke movements are from time to time sufficient, the printing mark is disposed at the correct position. In other words, the embossing lines are then in the correct location with respect to the transverse sealing unit, for example relative to the blade thereof. The tube is then correctly set relative to the processing station, that is to say the transverse sealing unit. The sensor detects that at the printing mark and gives a signal which on the one hand switches on the separate drives for the folding elements so that they are moved or pivoted into the condition of being moved away from each other and at the same time the product feed is switched on so that the product which acts within the tube develops, in opposition to folding and gripping forces from the exterior, certain counteracting forces which facilitate and improve the folding procedure and the configuration of the subsequently filled pack.

By virtue of the described folding elements and the movements thereof, the initial phase when setting the tube in the packaging machine lasts for a substantially shorter period of time than was hitherto usual, and substantially less waste material is sacrificed. The fear of damage to the tube due to the folding flaps which cannot be switched off in operation is eliminated. The entire handling of the empty packaging material tube, including sterilisation thereof, are made easier.

Figure 2:
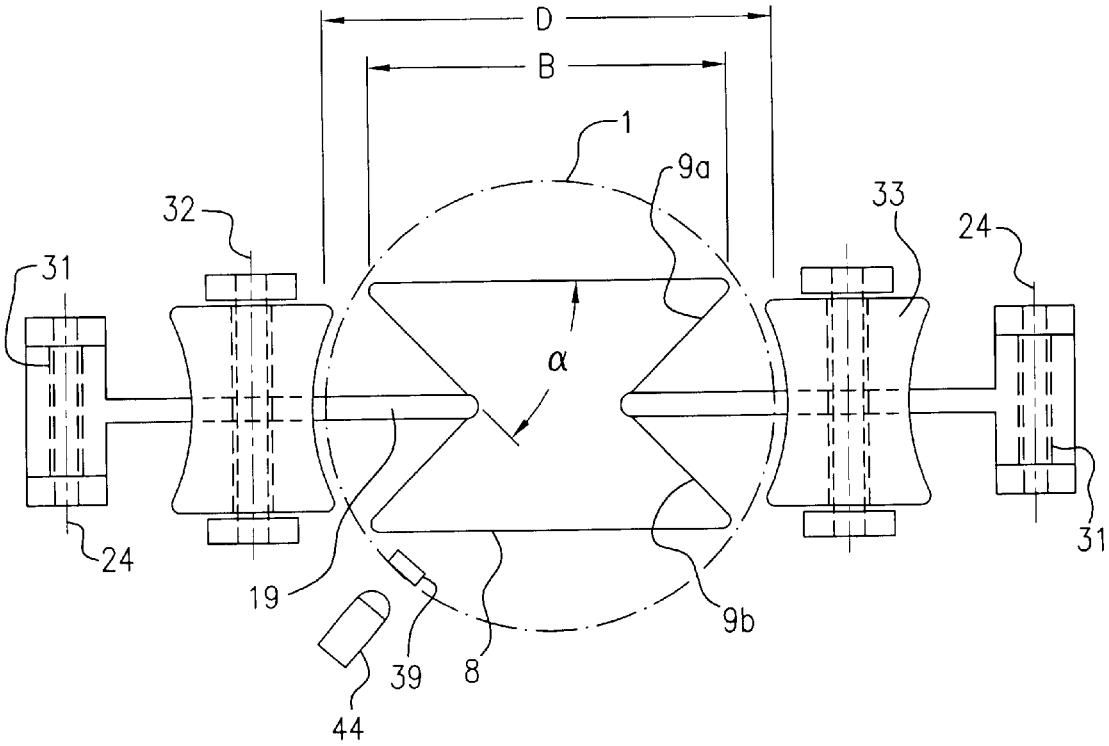
Figure 3:
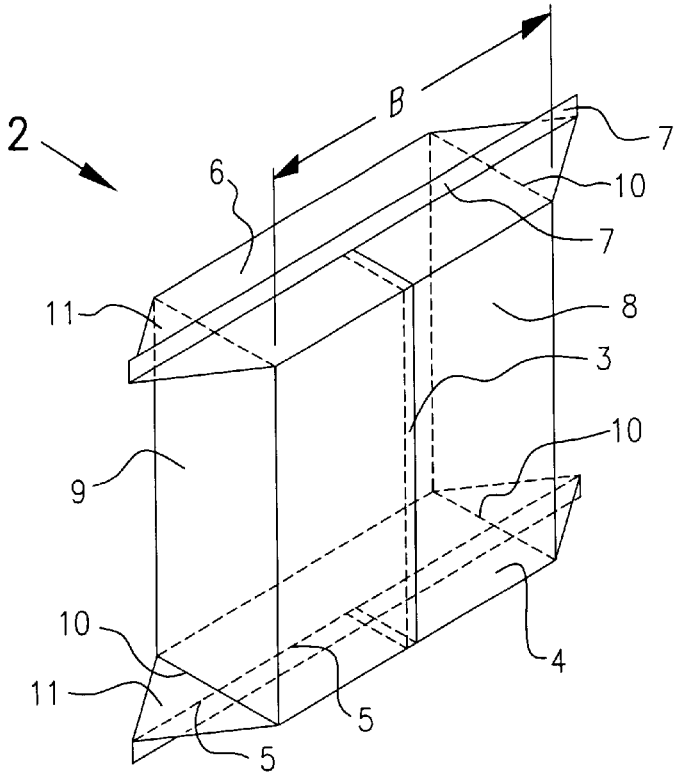
Figure 4:
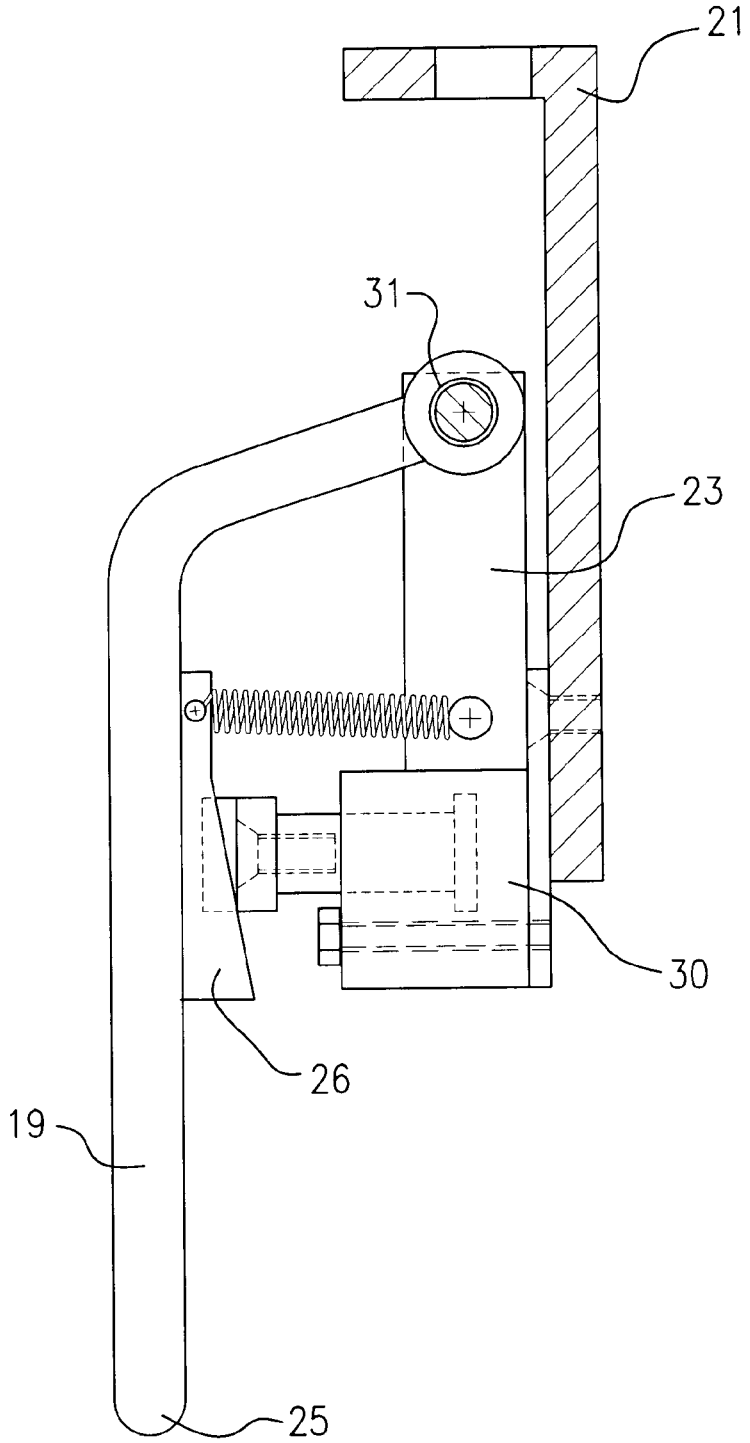
Figure 5:
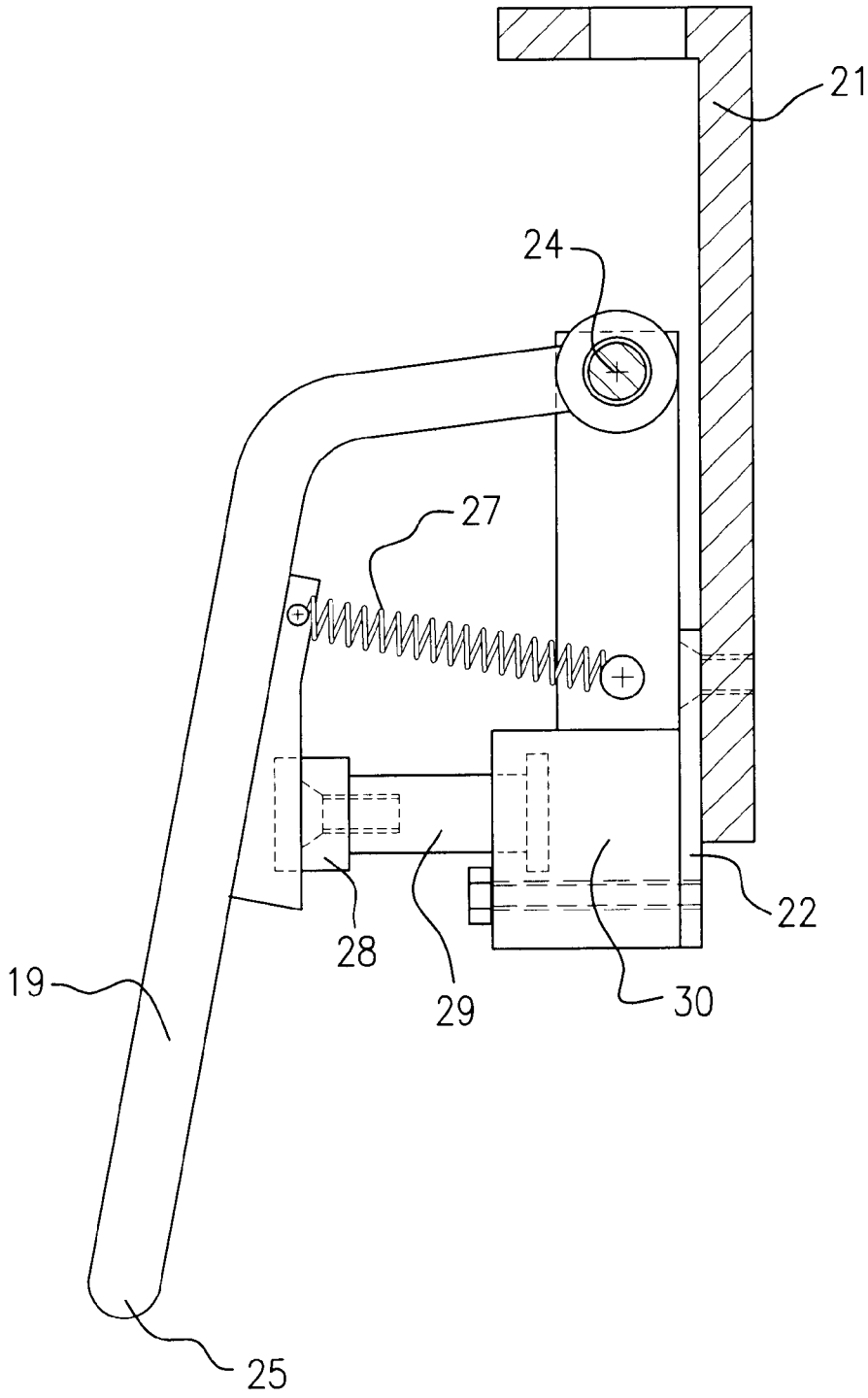
Figure 6:
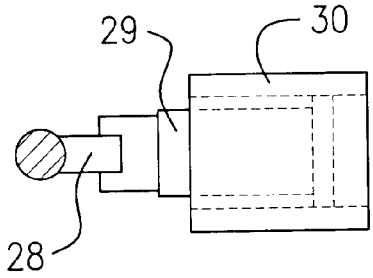
Figure 7:
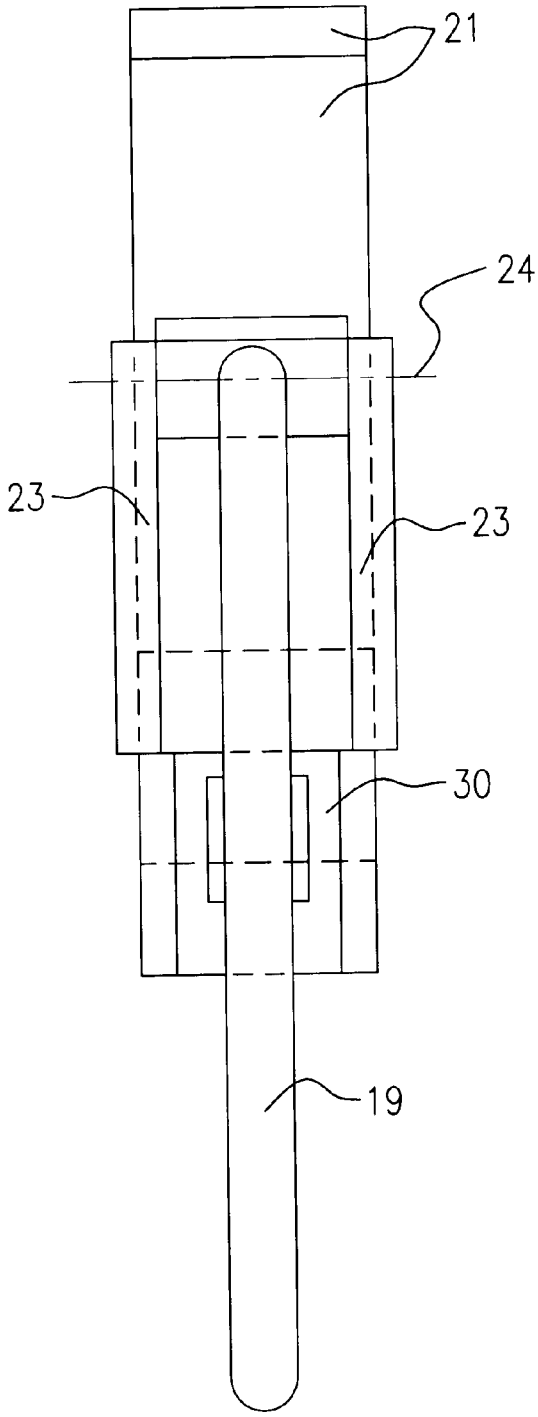
Figure 8:
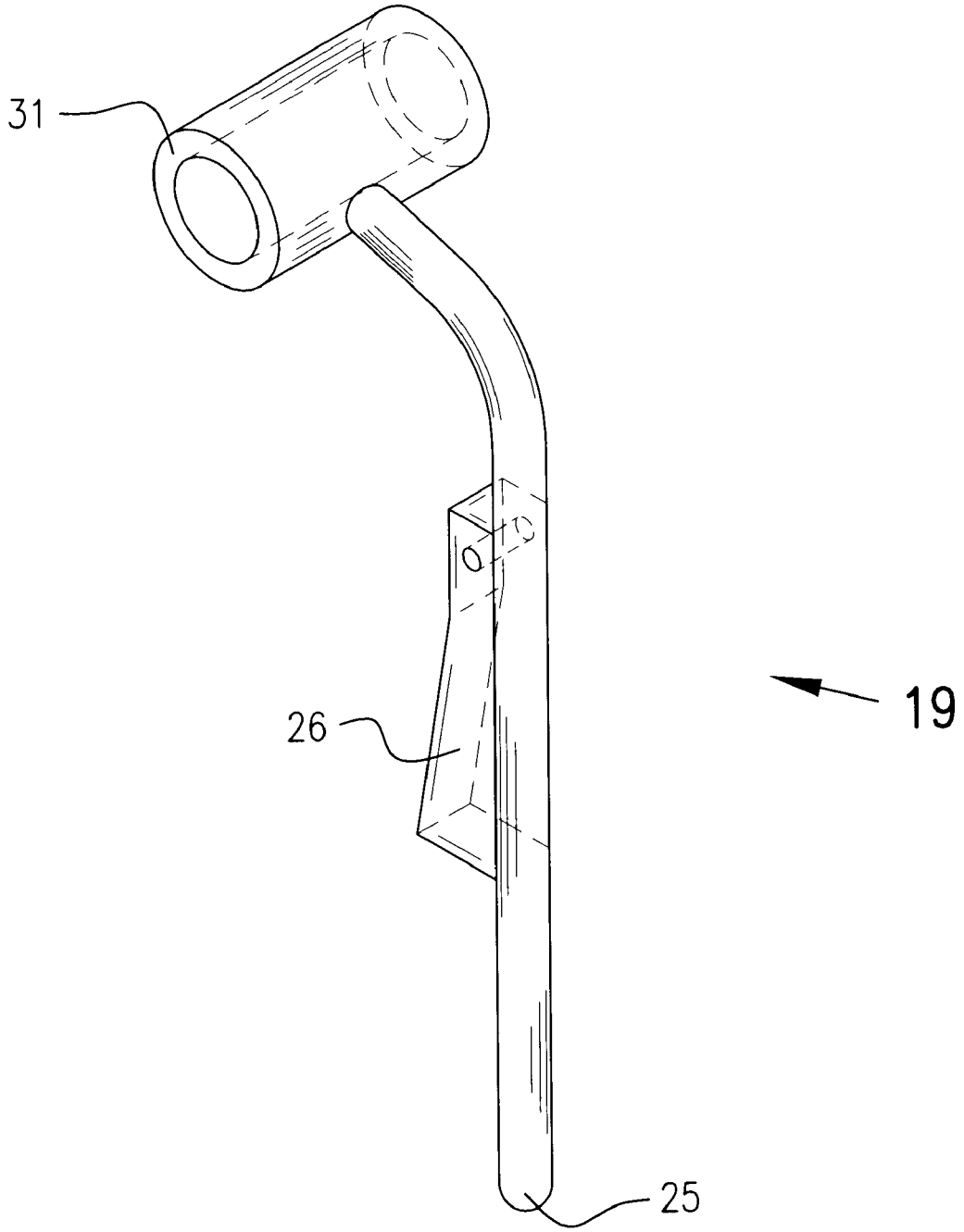
Figure 9:
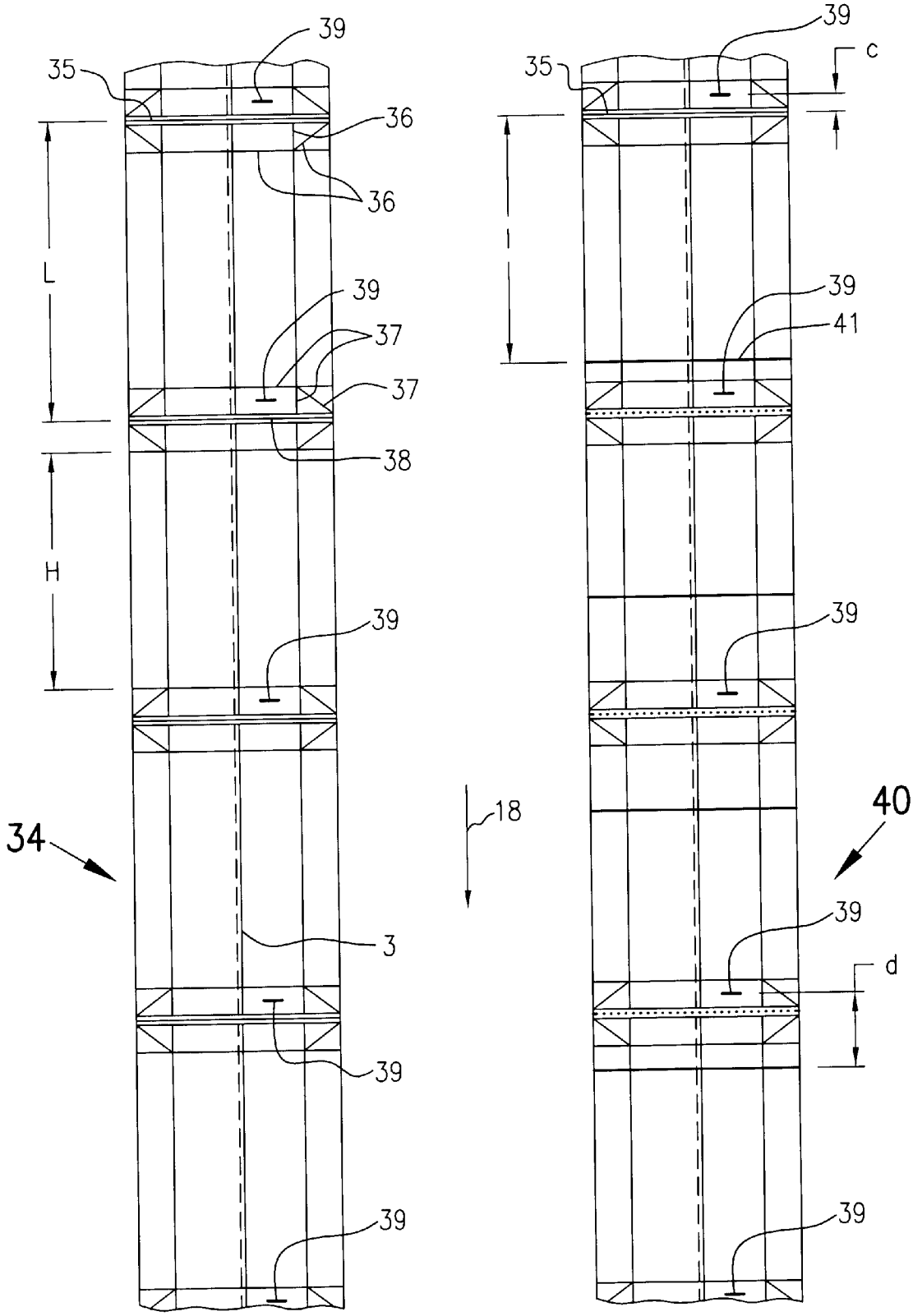
Figure 10:
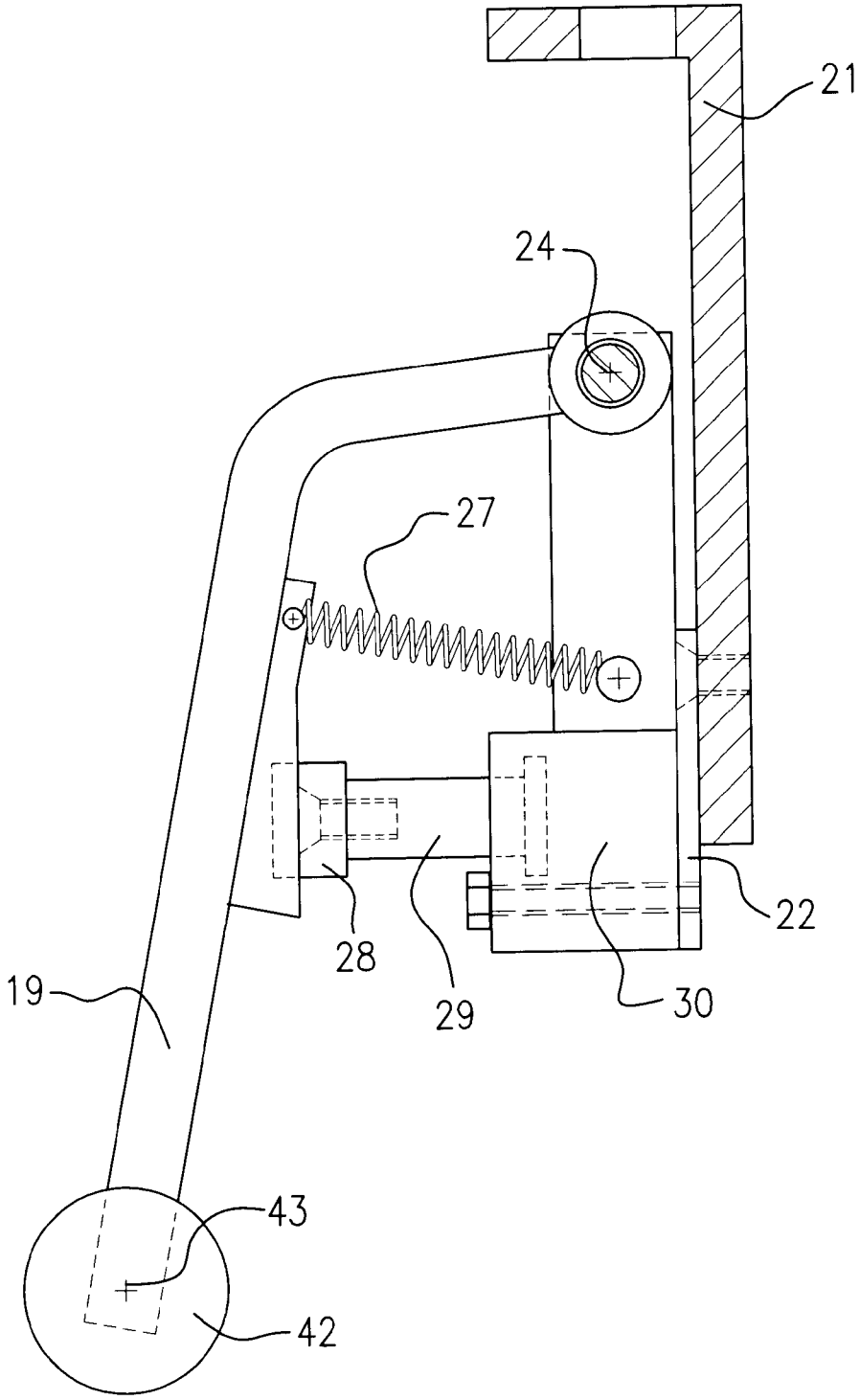
Figure 11:
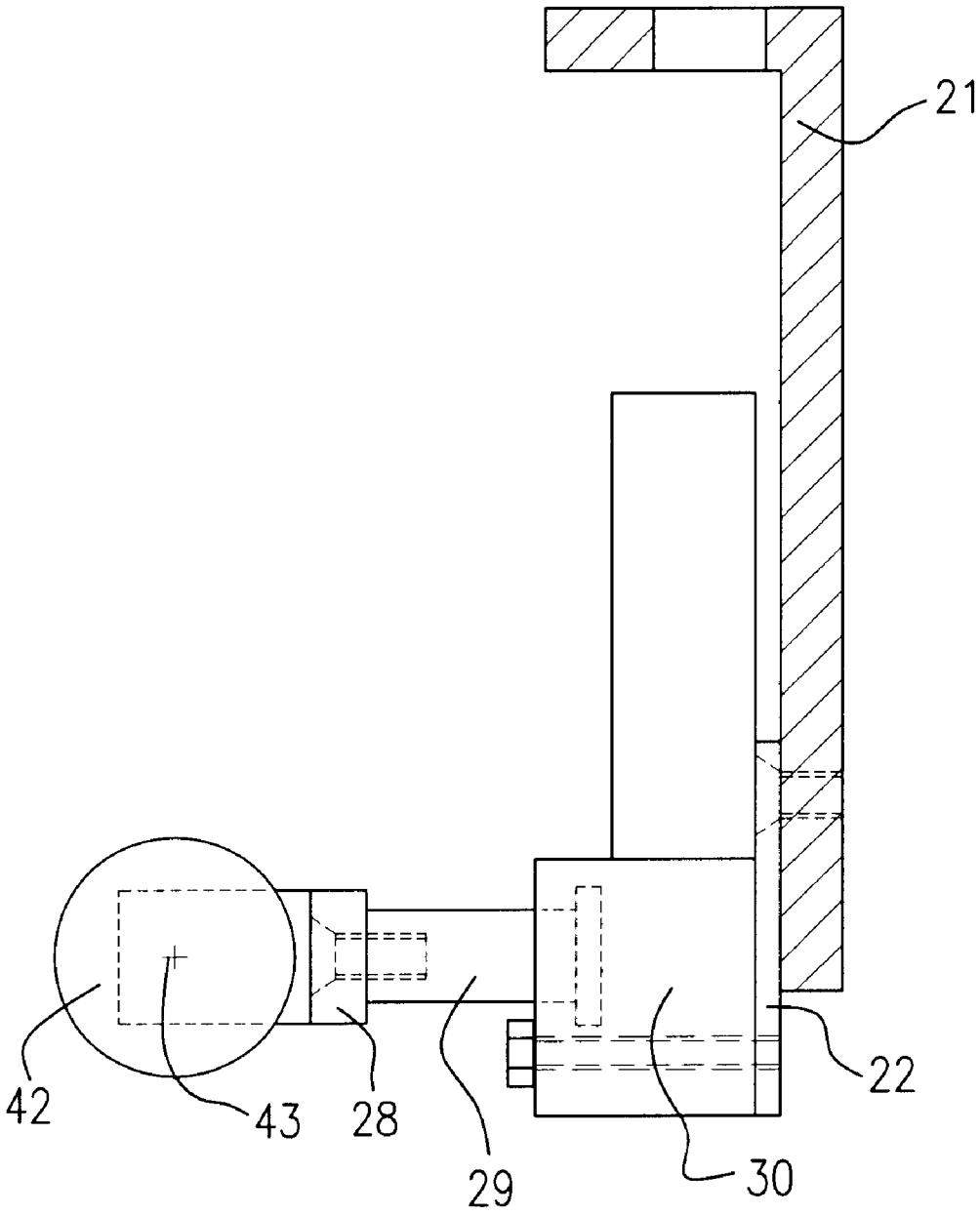

Further advantages, features and possible uses of the present invention will be apparent from the description hereinafter of preferred embodiments with reference to the accompanying drawings in which:

FIG. 1 shows a portion of a packaging machine in the region of the transverse sealing unit, above which the folding elements in the form of folding fingers are arranged and act on the vertically downwardly moving broken-away tube of packaging material, FIG. 2 is a cross-sectional view of the tube in the folded-together condition with the folding fingers acting thereon, above which are arranged the shaping rollers, FIG. 3 is a perspective view showing a finished filled parallelepipedic pack whose triangular flaps at the bottom and at the top wall still project horizontally, in the configuration that the pack presents before the final shaping operation, FIG. 4 is a view on an enlarged scale showing a folding finger with its drive and its holder, here in the condition of being moved away from each other (out of engagement), FIG. 5 is a comparable view of the folding finger to FIG. 4, except that here it is shown in the condition of being moved towards each other (activated), FIG. 6 shows the drive of the folding finger in its position shown in FIG. 4, FIG. 7 is a side view of the folding finger when viewing from left to right in FIG. 4, FIG. 8 is a perspective view showing the configuration of the folding finger itself without drive and holder, FIG. 9 is a plan view of two tubes in the laid-flat condition for illustrating the displacement of the printing mark in the start-up phase with activated folding elements (at the right) relative to the laid-flat tube without the action of folding elements (at the left), FIG. 10 is a comparable view of the folding element which is again in the form of a folding finger to FIG. 5, except that the operative end of the folding finger is here provided with a folding roller, and FIG. 11 shows a further embodiment of the folding element in the form of a folding roller which is arranged horizontally reciprocatably on a guide, with a pneumatic drive, A packaging machine which is not shown in greater detail is intended to produce from a tube 1 packs 2 comprising a packaging material with paper coated on both sides with plastic material.

The pack 2 which is shown in a perspective view in FIG. 3 after filling and shaping thereof has a longitudinal sealing seam 3, in the bottom 4 a transverse sealing seam 5 and in the upper end portion 6 a transverse sealing seam 7. Disposed opposite the front wide side wall 8 is a rear wide side wall (not visible), and the same also applies in regard to the left-hand narrow side wall 9. A respective triangular flap 11 can be folded over around the respective base fold line 10, the flap 11 not yet being folded over in the view shown in FIG. 3 but protruding horizontally in the plane of the bottom 4 and the top wall 6 respectively.

The procedure of folding in particular the bottom 4 and the top wall 6 of the pack 2 from the tube 1 of packaging material of circular cross-section upstream at the top in FIG. 1 (shown in dash-dotted line in FIG. 2) is essentially effected by the transverse sealing unit 12 which is shown generally in FIG. 1. Indicated in diagrammatic form of the transverse sealing unit 12 in a frame 13 are transverse sealing jaws 14 between which a blade (not shown) can operate for severing the tube 1. Arranged at the top on the frame 13 are folding flaps 16 which are pivotable about pivot axes 15 and whose engagement position (in on-going normal operation) is shown in solid lines in FIG. 1 while the upwardly pivoted position is shown in dash-dotted line. A correction device 17 is fixed on the right to the frame 13 of the transverse sealing unit 12 and controls the folding flaps 16, in other words, with that correction device 17, the movement of the folding flaps 16, which is shown in greatly simplified form in FIG. 1, can be increased or reduced in length. In that way, more or less material can be advanced in the intermittent movement of the tube 1, in the conveyor direction 18.

Disposed upstream of the transverse sealing unit 12, that is to say in the opposite direction to the conveyor direction 18 of the tube 1, above the transverse sealing unit, are the two folding elements which are here in the form of folding fingers 19 and of which one folding finger is shown in the perspective view in FIG. 8, without its holder and its drive. Mounted to the machine support stand 20 on each of the sides which are in diametrally opposite relationship with respect to the tube 1 are respective holding angle members 21 on which a holder 22 and a side wall 23 are fixed, on the side towards the folding finger 19 and thus also towards the tube 1. The side wall 23 carries at the top a pivot axis 24 about which the curved, bar-shaped, elongate folding finger 19 is mounted pivotably to the side wall 23. An arm 26 is welded on the side remote from the tube 1, on that straight part of the folding finger 19 at which the rounded operative end 25 is disposed at the bottom thereof. Held to the arm 26 is the one end of a tension spring 27 whose other end is also secured to the side wall 23. Also fixed to the arm 26 is a guide 28 which by way of a piston rod 29 provides a connection to a pneumatic cylinder 30. The latter can pivot the folding finger 19 from the position of being moved away from each other, as shown in FIG. 4, against the force of the tension spring 27, into the position of being moved towards each other, as shown in FIG. 5. When the pneumatic cylinder is taken out of operation the tension spring 27 moves the holding finger 19 back into its outward rest position again.

The pivot axis 15 of the folding flap 16 is disposed parallel to the pivot axis 24 of the mounting 31 of the folding finger 19. The axis of rotation 32 of the shaping roller 33 is also parallel to the pivot axis 24 of the folding finger 19, upstream and above the respective folding finger 19. The configuration and support function of the shaping roller 33 can best be seen from the cross-sectional view in FIG. 2.

FIG. 9 shows at the left the web 34 of packaging material, that is to say the tube 1 in a condition of being laid together flat, wherein each blank is of a length L, encompassed from the cut line 35 above the embossing lines 36 on the upper end portion, with the height H of the actual pack, to beyond the embossing lines 37 of the bottom to the cut line 38 thereof; that applies for each blank. The longitudinal sealing seam 3 extends over all blanks and each blank carries a printing mark 39.

Just as in the case of the laid-flat web 34 of the tube 1, in the case of the web 40 of the laid-flat tube 1 which is shown at the right in FIG. 9, the conveyor direction is indicated by the arrow 18 and is directed vertically downwardly. The right-hand web 40 is subdivided into shorter portions of a length I, which is the stroke movement with which the transverse sealing unit 12 respectively intermittently advances the tube 1 in the conveyor direction 18. While the length L of the actual blank extends from one cut line 35 to the next cut line 38, the length I is shorter and thus less than L. If blanks of the later pack 2 as shown in FIG. 3 are not cut out of the web as in the case of the web 34, but if the cushion-like or shingle-like portions I are cut out of the web 40 so that a cut line 35 at the top is at the spacing I from the next cut line 41, it is then possible to obtain on the same length of four blanks of the left-hand web 34, five of the smaller portions I of the right-hand web 40. If those two webs with the spacings of different sizes between the cut lines are related to each other, then the comparison in FIG. 9 shows how the printing mark 39 at the top in both webs lies just above the blank, in the next following blank the left-hand web 34 does not exhibit any changes in the position of the printing mark 39 while in the case of the right-hand web 40 the printing mark 39 is already a distance into the blank which is next in the transport direction 18. That distance increases from one portion to another, as can be seen from the right-hand web 40 in FIG. 9 when the printing marks 39 at the right are compared in relation to the cut lines 35, 41. For example the spacing of the printing mark 39 from the cut line 35 in the case of the portion which is broken away at the top is of the short length c while finally in the penultimate portion the spacing is d (double arrow). It will be seen how in operation, with intermittent movement of the tube 1, the printing mark 39 can very rapidly move to where it is correctly positioned in relation to the transverse sealing unit 12, as determined by a sensor 44 detecting printing mark 39. At that moment of correct positioning of the printing mark 39 the folding fingers 19 whose operative ends 25 as shown in FIG. 1 in the condition of being moved towards each other are at a spacing a are pulled away from each other in the direction of the force of the tension spring 27. That does away with the central folding-in of the narrow side wall 9 which is shown in FIG. 2 by the angle $\alpha$. In FIG. 2 that side wall is subdivided by the folding-in action of the folding fingers 19, into two elongate strips 9*a* and 9*b*. Shown above the strip 9*a* is the substantially flat side wall 8 which is shown more specifically as a straight line and which forms the one limb of the angle $\alpha$.

The strip 9*a* of the adjacently adjoining side wall 9 forms the other limb of the angle $\alpha$.

FIG. 10 is similar in structure to FIG. 5. The rounded operative end 25 shown in FIG. 5 is however of a different configuration in the embodiment shown in FIG. 10. More specifically, a folding roller 42 is mounted freely rotatably about an axis of rotation 43 at the lower free end of the folding finger 19. Control of the folding finger 19 is implemented in accordance with the manner described hereinbefore. The folding roller 42 however comes into contact with the tube 1 instead of the rounded-off operative end 25.

Finally FIG. 11 shows an embodiment which is modified in relation to FIG. 10 and in which the folding roller 42 is again provided freely rotatably on the guide 28 at the front on the left. The axis of rotation 43 extends parallel to the pivot axis 15 of the folding flap 16, that pivot axis not being shown in FIG. 11. A view of FIG. 1 shows straightaway the arrangement of the parts and the direction of the axes. In the view shown in FIG. 11 the axis of rotation 43 is perpendicular to the plane of the paper (like the axes 43 and 24 in FIG. 10).

When the piston rod 29 is advanced horizontally towards the left transversely with respect to the tube 1, then the folding roller 42 with its periphery comes into operative engagement with the outside surface of the tube 1. It will be appreciated that the same arrangement is also provided in mirror-image relationship on the opposite side of the tube. By retraction of the folding roller 42 in FIG. 11 towards the right it moves into the inoperative position.

List of References

1 tube
2 pack
3 longitudinal sealing seam
4 bottom of the pack
5 transverse sealing seam
6 upper end portion of the pack
7 transverse sealing seam in the upper end portion
8 front wide side wall
9 narrow side wall
9*a*, 9*b* subdivision of the side wall into two strips
10 bottom fold line
11 triangular flap
12 transverse sealing unit
13 frame
14 transverse sealing jaws
15 pivot axis of the folding flap
16 pivotable folding flaps
17 correction device
18 conveyor direction of the tube
19 folding finger (folding element)
20 machine support stand
21 holding angle member
22 holder
23 side wall
24 pivot axis
25 rounded-off operative end
26 arm
27 tension spring
28 guide
29 piston rod
30 pneumatic cylinder
31 mounting of the folding finger
32 axis of rotation of the shaping roller
33 shaping roller
34 left-hand web of packaging material
35 cut line
36 embossing lines on the upper end portion
37 embossing lines of the bottom
38 cut line
39 printing mark
40 right-hand web of packaging material
41 cut line
42 folding roller (folding element)
43 axis of rotation of the folding roller 42
c short length
d printing mark-cut line spacing
I stroke movement length L blank length

What is claimed is:

1. An apparatus for arranging a tube (1) of packaging material in relation to a processing station (12) in a packaging machine in which a tube (1) of round cross-section formed from a printed web (34) of packaging material provided with a printing mark (39) and embossing lines (36, 37), is closed by longitudinal sealing (3), filled and shaped in a transverse sealing unit (12) and divided into parallelepipedic packs (2), wherein the transverse sealing unit is designed for intermittently conveying the tube (1) with an adjustable stroke movement and is provided in relation to the tube (1) on diametrically opposite sides of the tube with folding slaps (16) pivotable about a pivot axes (15); said apparatus having a sensor arranged to sense the printing mark (39), wherein on the upstream side of each folding flap (16) is a folding element (19, 42) which is activated by the sensor upon detection of the printing marks, and by means of which the tube (1) can be folded into a width (B) approximately equal to the width (B) of the finished pack (2) in such a way that the tube (1) is out of engagement from the folding flaps (16).

2. An apparatus according to claim 1 wherein the folding elements (19, 42) symmetrically fold in the tube (1) to such an extent that in cross-section between angularly folded-in side wall (9*a*, 9*b*) and adjacent flat side wall (8) there is an angle ($\alpha$) of between about 5° and about 85°, preferably between about 15° and about 70° and quite particularly preferably between about 30° and about 60°.

3. An apparatus of claim 2 wherein angle ($\alpha$) is between about 15° and about 70°.

4. An apparatus according to claim 3 wherein the folding elements (19) centrally engage side walls (9) of tube (1) at positions which are in diametrally opposite relationship in a cross-section of the tube (1).

5. An apparatus according to claim 2 wherein the folding element is a folding finger having an operative end (25) which is arranged downstream of the pivot axis (24), carrying a freely rotatable folding roller (42) at least on a side towards the tube (1).

6. An apparatus according to claim 5 wherein a spacing (a) of the operative ends (25) of the folding elements (19, 42) from each other:

(a) in the condition of being moved away from each other is greater than a diameter (D) of the tube (1), and (b) in the condition of being moved towards each other is smaller than a width (B) of the substantially flat side wall (8) of the folded-in tube (1), which substantially flat side wall is adjacent to the side wall (9*a*, 9*b*) which is folded in angularly in cross-section.

7. An apparatus according to claim 2 wherein a spacing (a) of the operative ends (25) of the folding elements (19, 42) from each other:

(a) in the condition of being moved away from each other is greater than a diameter (D) of the tube (1), and (b) in the condition of being moved towards each other is smaller than a width (B) of the substantially flat side wall (8) of the folded-in tube (1), which substantially flat side wall is adjacent to the side wall (9*a*, 9*b*) which is folded in angularly in cross-section.

8. An apparatus according to claim 2 wherein the folding elements (19) centrally engage side walls (9) of tube (1) at positions which are in diametrally opposite relationship in a cross-section of the tube (1).

9. An apparatus according to claim 1 wherein the folding element (19) is an elongate folding finger (19) pivotable about a pivot axis (24) which is secured to the machine and which is arranged parallel to the pivot axis (15) of the folding flap (16) and wherein the folding finger (19) extends from its pivot axis (24) along the tube (1) to a position in front of the transverse sealing unit (12).

10. An apparatus according to claim 9 wherein folding element (19) is a folding finger having an operative end (25) arranged downstream of the pivot axis (24), rounded off at least on a side towards the tube (1).

11. An apparatus according to claim 10 wherein a spacing (a) of the operative ends (25) of the folding elements (19, 42) from each other:

(a) in the condition of being moved away from each other is greater than a diameter (D) of the tube (1), and (b) in the condition of being moved towards each other is smaller than a width (B) of the substantially flat side wall (8) of the folded-in tube (1), which substantially flat side wall is adjacent to the side wall (9*a*, 9*b*) which is folded in angularly in cross-section.

12. An apparatus according to claim 9 wherein the folding elements (19) centrally engage side walls (9) of tube (1) at positions which are in diametrally opposite relationship in a cross-section of the tube (1).

13. An apparatus according to claim 1 wherein a shaping roller (33) is freely rotatably arranged upstream of the pivot axis (24) of each folding element (19).

14. An apparatus according to claim 1 wherein folding element (19) is a folding finger having an operative end (25) arranged downstream of the pivot axis (24), rounded off at least on a side towards the tube (1).

15. An apparatus according to claim 14 wherein a spacing (a) of the operative ends (25) of the folding elements (19, 42) from each other:

(a) in the condition of being moved away from each other is greater than a diameter (D) of the tube (1), and (b) in the condition of being moved towards each other is smaller than a width (B) of the substantially flat side wall (8) of the folded-in tube (1), which substantially flat side wall is adjacent to the side wall (9*a*, 9*b*) which is folded in angularly in cross-section.

16. An apparatus according to claim 1 wherein the folding element is a folding finger having an operative end (25) which is arranged downstream of the pivot axis (24), carrying a freely rotatable folding roller (42) at least on a side towards the tube (1).

17. An apparatus according to claim 16 wherein a spacing (a) of the operative ends (25) of the folding elements (19, 42) from each other:

(a) in the condition of being moved away from each other is greater than a diameter (D) of the tube (1), and (b) in the condition of being moved towards each other is smaller than a width (B) of the substantially flat side wall (8) of the folded-in tube (1), which substantially flat side wall is adjacent to the side wall (9*a*, 9*b*) which is folded in angularly in cross-section.

18. An apparatus according to claim 1 wherein each folding element (19, 42) has its own drive which is separately actuable.

19. An apparatus according to claim 1 wherein the folding element (42) is a folding roller (42) which is mounted rotatably on a guide (28) having an axis of rotation (43) extending parallel to the pivot axis (15) of the folding flap (16), and wherein the guide is driven movably forwards and backwards transversely with respect to the tube (1).

20. An apparatus according to claim 1 wherein the folding elements (19) centrally engage side walls (9) of tube (1) at positions which are in diametrally opposite relationship in a cross-section of the tube (1).

* * * * *